United States Patent [19]

Wieland, Jr.

[11] Patent Number: 4,903,881

[45] Date of Patent: Feb. 27, 1990

[54] PORTABLE FASTENER SETTING PRESS

[75] Inventor: Howard N. Wieland, Jr., Holliston, Mass.

[73] Assignee: TRW Inc., Cleveland, Ohio

[21] Appl. No.: 269,439

[22] Filed: Nov. 9, 1988

[51] Int. Cl.[4] ..... B21J 15/10

[52] U.S. Cl. ..... 227/143; 81/363; 100/231

[58] Field of Search ..... 227/15, 143, 144; 29/268, 276; 81/363, 367, 369; 72/450, 451, 409; 100/231, 281, 283

[56] References Cited

U.S. PATENT DOCUMENTS

| | | | |
|---|---|---|---|
| D. 22,112 | 6/1971 | Hoover | D8/5 |
| 455,167 | 6/1891 | Carl | 227/15 |
| 2,875,655 | 3/1959 | Lako | 81/363 X |
| 3,837,211 | 9/1974 | Gress et al. | 81/363 X |
| 4,144,738 | 3/1979 | Dziura et al. | 81/363 X |
| 4,295,591 | 10/1981 | Lundstrom | 227/142 |
| 4,478,114 | 10/1984 | Arena | 81/363 |

*Primary Examiner*—Paul A. Bell

*Assistant Examiner*—James Wolfe

*Attorney, Agent, or Firm*—Fay, Sharpe, Beall, Fagan, Minnich & McKee

[57] ABSTRACT

A manually operable press for installing fasteners in flexible material comprises a one piece relatively rigid frame of generally C-shape having a vertically extending back portion and a pair of laterally extending and vertically spaced upper and lower legs. A ram is carried in the upper leg and is guided for reciprocating movement along a path toward and away from the lower leg. The ram is driven toward the lower leg by a drive assembly comprising first and second drive levers mounted for pivotal movement in the upper end of the frame. The first drive lever has a first end in driving engagement with the ram and a second end drivingly connected by a toggle link to a first end of the second drive lever. A second end of the second lever constitutes a manual drive handle and is arranged to extend generally parallel to the back portion of the frame when the second lever has been moved to a position wherein the ram member is driven to generally the maximum extent of its movement toward the lower leg.

5 Claims, 2 Drawing Sheets

PORTABLE FASTENER SETTING PRESS

BACKGROUND OF THE INVENTION

The subject invention is directed toward the fastener art and, more particularly, to a manually operable fastener setting press.

The invention is especially suited for use in installing snap fasteners and will be described with reference thereto; however, as will be appreciated, the invention is capable of broader application and could be used for various punching and cutting operations, as well as, installing a variety of types of fasteners.

Snap fasteners are common on many types of products including various fabric covers and tops used in the industrial fabric and marine industry These covers and tops frequently require on-site repair and replacement. Such repair and replacement necessitates cutting and punching relatively heavy fabric, webbing, and synthetic materials, as well as setting the snap fasteners.

Previously, the tools used for the cutting, punching and snap fastener setting have been manually operated pliers, hand tools with over center mechanisms, and hammer struck, punch type tools. The plier tools have been marginal in their ability to apply leverage forces to cut or punch the tops and covers and to set the snap fastener components. Current tools are also generally dedicated in that they perform only a cutting function or a fastener setting function. The hammer struck tools have also been unsatisfactory because they are cumbersome, require a strong support to hammer against, and often fracture because they are not held in proper alignment.

SUMMARY OF THE INVENTION

The subject invention overcomes the problems noted with respect to the prior tools and provides a manually operable press which is relatively simple in construction but is capable of generating the large forces necessary for pre-cutting application material and fastener setting.

In accordance with the invention there is provided a manually operable press particularly suited for installing fasteners in industrial and marine fabric materials. The press generally comprises a one piece, rigid frame having a C-shape with a vertically extending back portion and a pair of laterally extending and vertically spaced upper and lower legs. The lower leg includes an upwardly extending base portion which is generally parallel to the back portion to define a vertically open, relatively long throat. A ram member is mounted in the upper leg and is guided for reciprocating movement toward and away from the base portion of the lower leg along a path generally parallel to the back portion. Drive means are provided for driving the ram in a direction toward the base portion of the lower leg. The drive means include first and second drive levers mounted for pivotal movement in the upper end of the frame about axes which extend transversely in the path of movement of the ram. The first drive lever has a first end in driving engagement with the ram and a second end extending rearwardly of the path. The second end of the first drive lever is drivingly connected to a first end of the second drive lever and a second end of the second drive member constitutes a manual drive handle. The manual drive handle portion is arranged to extend generally parallel to the back portion of the frame when the second lever has been moved to a position wherein the ram member has been driven generally to the maximum extent of its movement toward the lower leg. Because operator hand pressure is applied to the second drive member and not to one end of the first lever greater force can be generated than is possible with the typical over-center type drive mechanism.

Preferably, and in accordance with a more limited aspect of the invention, the second end of the first lever and the first end of the second lever are pivotally connected to opposed ends of a toggle link. The particular linkage and frame arrangement described allows extremely high forces to be generated on the ram. The relationship between the manual handle and the frame facilitates manual application of driving forces through the linkage to the ram. In addition, because of the design of the frame, an extremely large effective throat is provided without necessitating a deep C-type of frame. That is, the base portion extending up from the lower leg is spaced only a slight distance from the back portion of the frame to thereby reduce the torque acting on both the upper and lower leg when the ram is driven toward the base.

Preferably, the ram is arranged to cooperate with a vertically adjustable tool support mounted in the lower leg in general alignment with the path of movement of the ram. The ram and the tool support can have a variety of different tool pairs releasably installed thereon to allow the same basic tool to be used for cutting, punching, and fastener setting operations. Moreover, by making the tool support n the lower leg adjustable, fine setting of the tool pairs is possible without adjustment of the driving mechanism. This simplifies the design of the driving mechanism and increases the number of different operations that the press can perform.

Preferably, the second end of the second lever which constitutes the manual drive handle is arranged so that it is closely adjacent to and generally parallel with the back of the frame when the ram is in its lowermost position. This permits extremely high forces to be manually generated because the frame and the handle are in a most suitable position for applying forces through a manual gripping operation.

As is apparent from the foregoing, a primary object of the invention is the provision of a manually actuable press type tool which is capable of generating extremely high forces between the ram and its associated tool support.

A still further object of the invention is the provision of a tool of the type described which is compact and capable of being readily converted between a variety of operations.

A still further object of the invention is the provision of a tool of the type described wherein the ram driving forces are manually generated and transmitted through a highly efficient toggle-link assembly.

The above and other objects and advantages will become apparent from the following description when read in conjunction with the accompanying drawings wherein.

DETAILED DESCRIPTION OF THE PREFERRED EMBODIMENT

Figure 2:
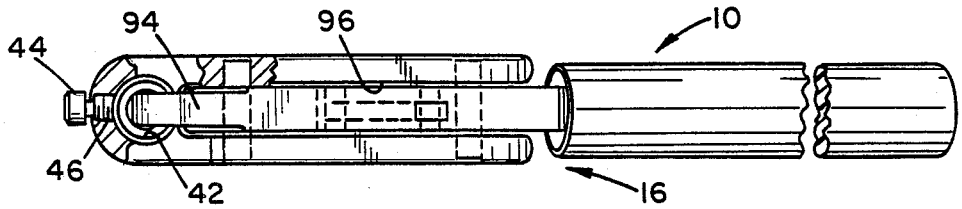
FIG. 2 is a top view of the tool of FIG. 1 (the view has been taken along line 2—2 of FIG. 1)
Figure 1:
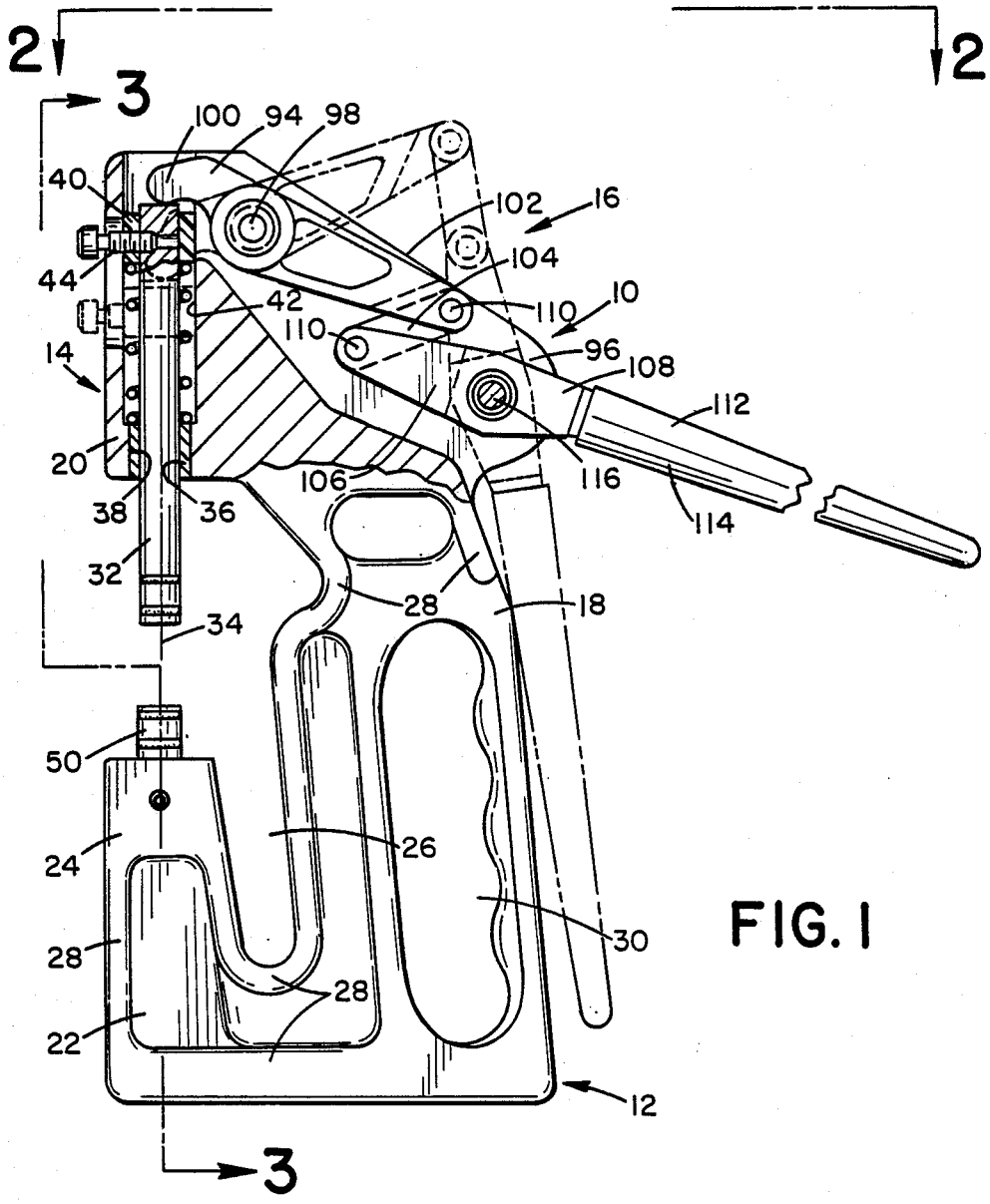
FIG. 1 is a side elevational view, partially in section, showing a preferred embodiment of a fastener setting tool formed in the subject invention.
Figure 3:
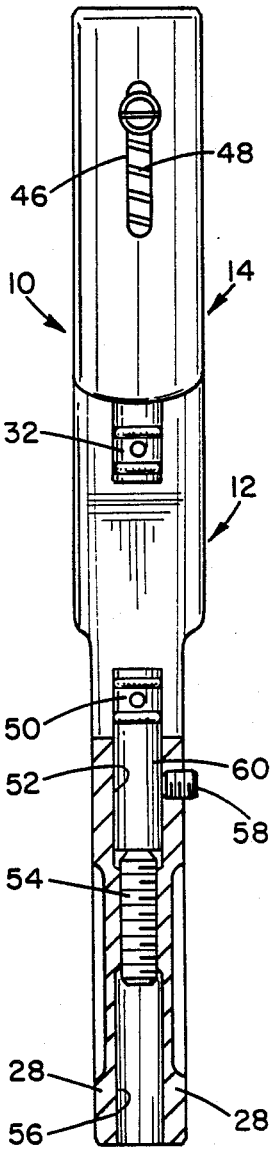
FIG. 3 is a cross-sectional elevational view taken along line 3—3 of 1.

Referring more particularly to the drawings wherein the showings are for the purpose of illustrating a preferred embodiment of the invention only, and not for the purpose of limiting same, FIGS. 1 through 3 show the overall arrangement of a manually actuated fastener setting press or tool 10 comprising a frame assembly 12 which carries a ram assembly 14 and a manual drive assembly 16. Broadly, the press is arranged such that actuation of the drive assembly 16 causes the ram assembly 14 to be driven vertically. Although not shown, a variety of different tools and tool couples can be used with the press.

Referring more particularly to the frame assembly 12, it will be noted the frame generally comprises a somewhat rigid, C-shaped structure having a generally vertically extending back portion 18 and a pair of vertically spaced laterally extending upper and lower leg members 20 and 22. The lower leg 22 carries a vertically extending base section 24 which is generally parallel to the back portion 18 to thereby define a relatively deep and vertically open throat area 26. The importance of the throat section 26 will subsequently be described in some detail. Preferably, and in accordance with the preferred embodiment, the frame is a one piece aluminum casting and is provided with suitable transversely extending reinforcing webs or the like 28. The rear or back portion 18 of the frame assembly 12 further includes an integral finger opening 30 which extends completely through the frame and has a generally vertical elongation for reasons which will subsequently be described.

Figure 4:
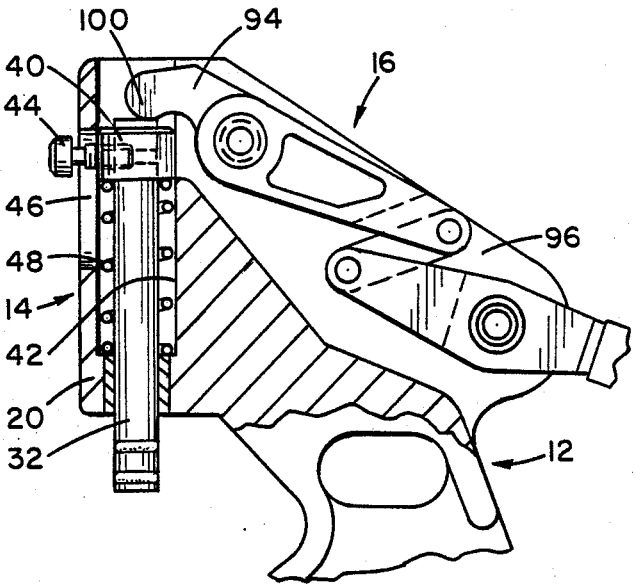
FIG. 4 is an enlarged view of the upper portion of the tool with the drive linkage shown in the rams uppermost position.

The ram assembly 14 includes a rigid ram member 32 which is carried in the upper leg 20 and is mounted for vertical reciprocation along a path 34 which extends generally parallel to the back portion 18 of the frame assembly 12. In the embodiment under consideration, the ram member 32 is cylindrical and is guided in a sleeve bearing 36 carried in an opening 38. The upper end of ram 32 has a collar 40 joined thereto and slidably received in a upwardly open cylindrical bore 42. The collar 40 is formed from a resilient plastic having a high lubricity and is retained in position on the ram 32 by a shoulder screw 44. The ram 32 is prevented from rotating in the bore 42 and the sleeve 36 by the shoulder screw 44. In this regard it should be noted, as best shown in FIG. 4, that the screw 44 is threaded into the ram 32 and has its shoulder portion guided in a slot 46 formed in the leg portion 20.

Biasing means in the form of a compression coil spring 48 acts to maintain the ram 32 continually biased upwardly. As illustrated, the spring 48 is carried in bore 42 and acts between the bottom of bore 42 and the underside of collar 40.

Referring again to FIG. 1, and with further reference to FIG. 3, it will be seen that the ram member 32 is arranged to cooperate with a tool support member 50 carried in the base portion 24. More particularly, tool support 50 has a generally cylindrical configuration and is mounted in a bore 52 formed through the base 24 and the lower leg 22. It should be noted that the tool support 50 is preferably in direct alignment with the axis of the ram 32. That is, the tool support 50 lies coaxial with the path of movement of the ram 32. Moreover, the tool support 50 is mounted so as to be vertically adjustable for precise predetermined location of the tool component carried thereby. For this purpose, as best seen in FIG. 3, a socket head set screw element 54 is received in the inner end of a threaded bore 56 which extends inwardly from the lower side of the leg 22. By adjusting the socket screw 54 vertically the position of the tool support 50 can be adjusted. Maintenance of the final adjusted position of the tool support 50 is assured by a set screw 58 threaded through the side of the base 24 and engaging a flat 60 formed on the side of the tool support.

Figure 5:
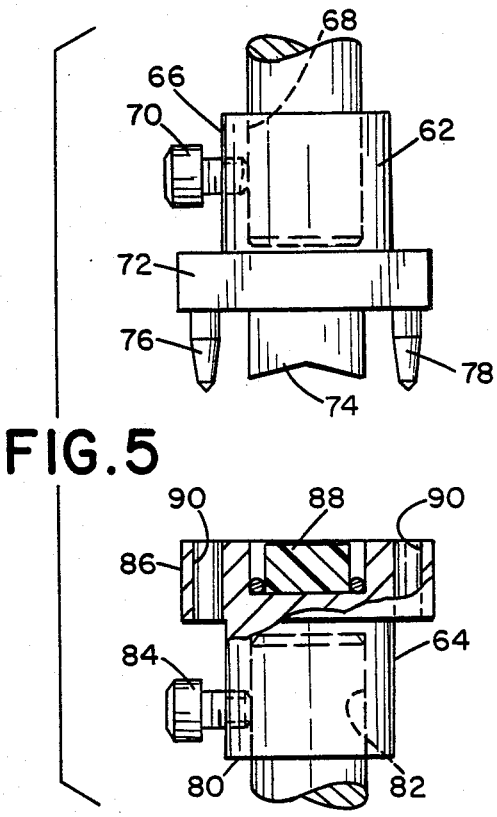
FIG. 5 shows a typical tool couple which could be used on the subject invention.

Clearly, many different types of tools and tool couples could be carried by the ram 32 and/or the tool support 50. Although forming no particular part of the subject invention, FIG. 5 shows a typical tool couple which could be installed on the ram 32 and the associated tool support post 50. As shown therein, the tool couple includes a pair of tool elements 62 and 64 adapted to be received on the ram 32 and the tool support 50 respectively. Specifically, the tool element 62 includes a cylindrical collar member 66 having an inwardly extending bore 68 adapted to closely receive the lower end of the ram 32. A set screw in the form of a socket head machine screw 70 is provided to connect the tool 62 to the ram 32. The lower end of the tool 62 comprises a rigid plate 72 and a cylindrical punch element 74. Also included are punch elements 76 and 78. The lower element 64 similarly includes a sleeve element 80 having an inwardly extending cylindrical bore 82 adapted to be closely received on the tool support 50. Preferably screws 70 and 84 are arranged to enter suitable grooves or openings in the ram 32 and post 50, respectively, to thereby act as keys and align the upper an lower tool couples.

A suitable socket head machine screw 84 is provided for releasably joining and keying element 64 to the support post 50. Connected to the upper end of the collar member 80 is a tool steel plate 86 provided with suitable openings 88 and 90 adapted to cooperate with the punch 74 and the punches 76, 78 respectively. As can be appreciated, when the tool elements 62, 64 are driven together by the movement of the ram 32 toward the tool support 50 and sheet material positioned therebetween is suitably punched and/or cut by the punches 74, 76 and 78.

Referring again to FIGS. 1, 2 and 4, the means for moving the ram 32 comprises the previously mentioned drive assembly 16. As shown, the drive assembly 16 includes a first drive lever 94 which is carried in a groove or recess 96 formed on the upper end of the frame assembly 12. The lever member 94 is mounted for pivotal movement about a first pivot pin 98 which extends transversely of the path of movement of the ram and is supported in the lateral sides of the recess 96. A first end 100 of the lever 94 is contoured as best shown in FIG. 4 and drivingly engages the upper end of the ram 32. The contour of the first end 100 is designed to minimize off-center loading of the ram 32. That is, the end 100 has a configuration to assure that forces are applied to the center of ram 32 with a minimum of off-center or non-axial loading.

The second end 102 of the lever 94 is bifurcated and connected through a link member 104 with the bifurcated first end 106 of a second lever 108. As illustrated, the link 104 is connected by suitable pivot pins 110 so that the lever assemblies and the pivot link can undergo movement from the solid line to the dotted line position of FIG. 1. The second end 112 of the lever 108 constitutes a manual drive handle for actuation of the ram 32. In the embodiment illustrated, the handle 112 is preferably provided with a suitable resilient hand grip cover or the like 114.

The lever 108 is mounted for pivotal movement about the pivot pin 116 which is supported from the lateral side walls of the recess 96 in the same manner and arrangement as the previously mentioned pin 98. The location of lever 108 relative to the frame assembly 12 is such that the handle portion of the lever 108 can move from the solid line position which is somewhat perpendicular to the back portion 18 of frame assembly 12 to the dotted line position which is generally parallel to the back portion 18 of frame assembly 12. It should be noted that as the handle section 112 approaches the dotted line position, the ram 32 has been moved substantially to its lowest or ultimate drive position. When the handle is approaching the dotted line position the second lever 108 and the link 102 are approaching an aligned position wherein the maximum force is transmitted to the ram 32. Additionally, at this time the handle portion 112 of the lever 108 is moving to a position wherein manual gripping between the handle and the finger opening 32 allows the user to apply maximum manual pressure to the handle. This allows extremely high forces to be generated between the ram 32 and the tool support element 50.

Referring again to the arrangement of the frame it should be noted that the throat area 26 is located such that the tool is capable of installing fasteners a significant distance from the edge of flexible material. That is, the material can be deflected into the throat area 26. Consequently, this desirable arrangement is achieved without requiring that the leg portions extend outwardly a great distance from the back 18 of the frame assembly 12. Thus, this arrangement does not result in increasing the stress load on the frame as takes place when the length of the leg portions is increased.

The invention has been described with reference to preferred and alternate embodiments. Obviously, modifications and alterations will occur to others upon the reading and understanding of this specification. It is intended to include all such modifications and alterations insofar as they come within the scope of the appended claims of the equivalents thereof.

What is claimed is:

1. A manually operable press for installing fasteners in flexible material comprising:

a relatively rigid frame of generally C-shape having a vertically extending back portion and a pair of laterally extending and vertically spaced upper and lower legs, said lower leg including an upwardly extending base portion which extends generally parallel to said back portion to define a vertically open throat;

a ram member carried in said upper leg and guided for reciprocating movement along a path generally parallel to said back portion toward and away from said base portion of said lower leg; and, drive means for driving said ram member toward said base portion of said lower leg, said drive means including first and second drive levers mounted for pivotal movement in the upper leg of said frame about fixed axes which extend transversely of the path of movement of said ram, said first drive lever having a first end in direct driving engagement with said ram and a second end extending rearwardly of said path, said second end of said first drive lever drivingly connected to a first end of said second drive lever by a connecting link member having a first end pivotally connected to the second end of said first drive lever and a second end pivotally connected to the second end of said second drive lever, and a second end of said second lever constituting a manual drive handle and arrange to extend generally parallel to the back portion of said frame when said second lever has been moved to a position wherein said ram member is driven to generally the maximum extent of movement toward said lower leg and, further wherein said second drive lever is mounted so that the second end thereof can pivot from a position where it extends generally perpendicular to said back portion to a position where it extends generally parallel to said back portion.

2. The press as defined in claim 1 wherein said frame includes a finger receiving opening for facilitating actuation of said second drive lever.

3. The press as defined in claim 1 including a vertically adjustable tool support mounted in said lower leg in general alignment with said path.

4. The press as defined in claim 1 including biasing means for maintaining said ram continually biased in a direction away from said base portion of said lower leg.

5. The press as defined in claim 1 wherein said throat has a substantial vertical open extent parallel to said back portion and said base portion.

* * * * *